US011735811B2

(12) United States Patent
Varnoosfaderani et al.

(10) Patent No.: US 11,735,811 B2
(45) Date of Patent: Aug. 22, 2023

(54) MULTI-BAND BASE STATION ANTENNAS HAVING CROSSED-DIPOLE RADIATING ELEMENTS WITH GENERALLY OVAL OR RECTANGULARLY SHAPED DIPOLE ARMS AND/OR COMMON MODE RESONANCE REDUCTION FILTERS

(71) Applicant: CommScope Technologies LLC, Hickory, NC (US)

(72) Inventors: Mohammad Vatankhah Varnoosfaderani, Sydney (AU); Zhonghao Hu, Westmead (AU); Ozgur Isik, Wentworth Point (AU)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 18/098,236

(22) Filed: Jan. 18, 2023

(65) Prior Publication Data

US 2023/0155277 A1 May 18, 2023

Related U.S. Application Data

(63) Continuation of application No. 17/511,875, filed on Oct. 27, 2021, now Pat. No. 11,569,567, which is a (Continued)

(51) Int. Cl.
*H01Q 21/26* (2006.01)
*H01Q 1/24* (2006.01)
(Continued)

(52) U.S. Cl.
CPC ..... *H01Q 1/246* (2013.01); *H01Q 21/062* (2013.01); *H01Q 21/065* (2013.01); *H01Q 21/26* (2013.01);
(Continued)

(58) Field of Classification Search
CPC .... H01Q 1/246; H01Q 21/062; H01Q 21/065; H01Q 21/26; H01Q 21/08; H01Q 5/42
See application file for complete search history.

(56) References Cited

U.S. PATENT DOCUMENTS 6,313,809 B1 11/2001 Gabriel et al.
9,570,804 B2 2/2017 Shang et al.
(Continued)

FOREIGN PATENT DOCUMENTS

CN 1107995 A 12/1999
CN 201011672 Y 1/2008
(Continued)

OTHER PUBLICATIONS

"EP Extended Search Report Corresponding to EP Application No. 18794344.4 dated Dec. 18, 2020 (8 pages)".
(Continued)

*Primary Examiner* — Joseph J Lauture
(74) *Attorney, Agent, or Firm* — Myers Bigel, P.A.

(57) ABSTRACT

A dual-polarized radiating element for a base station antenna includes a first dipole that extends along a first axis, the first dipole including a first dipole arm and a second dipole arm and a second dipole that extends along a second axis, the second dipole including a third dipole arm and a fourth dipole arm and the second axis being generally perpendicular to the first axis, where each of the first through fourth dipole arms has first and second spaced-apart conductive segments that together form a generally oval shape.

20 Claims, 13 Drawing Sheets

Related U.S. Application Data continuation of application No. 16/943,584, filed on Jul. 30, 2020, now Pat. No. 11,322,827, which is a continuation of application No. 15/897,388, filed on Feb. 15, 2018, now Pat. No. 10,770,803.

(60) Provisional application No. 62/500,607, filed on May 3, 2017.

(51) Int. Cl.

| | |
|---|---|
| ***H01Q 21/06*** | (2006.01) |
| *H01Q 5/48* | (2015.01) |
| *H01Q 1/52* | (2006.01) |
| *H01Q 21/08* | (2006.01) |

(52) U.S. Cl.

CPC ..... *H01Q 1/24* (2013.01); *H01Q 1/526* (2013.01); *H01Q 5/48* (2015.01); *H01Q 21/08* (2013.01)

(56) References Cited

U.S. PATENT DOCUMENTS

| | | | | |
|---|---|---|---|---|
| 2007/0146225 | A1 | 6/2007 | Boss et al. | |
| 2007/0241983 | A1 | 10/2007 | Cao et al. | |
| 2012/0098725 | A1 | 4/2012 | Lytle et al. | |
| 2015/0295313 | A1 | 10/2015 | Zimmerman et al. | |
| 2016/0275322 | A1 | 9/2016 | Carrender | |
| 2020/0067197 | A1* | 2/2020 | Tang | H01Q 5/42 |

FOREIGN PATENT DOCUMENTS

| | | | |
|---|---|---|---|
| CN | 101714702 | A | 5/2010 |
| CN | 101916910 | A | 12/2010 |
| CN | 104953241 | A | 9/2015 |
| CN | 113795979 | A | 12/2021 |
| EP | 2736117 | A1 | 5/2014 |
| GB | 2517735 | A | 3/2015 |
| WO | 2016081036 | A1 | 5/2016 |
| WO | 2017003374 | A1 | 1/2017 |

OTHER PUBLICATIONS

"First Examination Report (English translation included), corresponding to Indian Application No. 201927045446, dated Sep. 17, 2021 (9 pages)".

"Notification of Transmittal of the International Search Report and the Written Opinion of the International Searching Authority, or the Declaration, for International Application No. PCT/US18/18661; dated Jun. 25, 2018, 22 pgs.".

* cited by examiner

MULTI-BAND BASE STATION ANTENNAS HAVING CROSSED-DIPOLE RADIATING ELEMENTS WITH GENERALLY OVAL OR RECTANGULARLY SHAPED DIPOLE ARMS AND/OR COMMON MODE RESONANCE REDUCTION FILTERS

CROSS-REFERENCE TO RELATED APPLICATIONS

The present application claims priority under 35 U.S.C. § 120 as a continuation of U.S. patent application Ser. No. 17/511,875, filed Oct. 27, 2021, which in turn is a continuation of U.S. patent application Ser. No. 16/943,584, filed Jul. 30, 2020, which in turn is a continuation of U.S. patent application Ser. No. 15/897,388, filed Feb. 15, 2018, which in turn claims priority under 35 U.S.C. § 119 to U.S. Provisional Patent Application Ser. No. 62/500,607, filed May 3, 2017, the entire content of each of which is incorporated herein by reference as if set forth in its entirety.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station. In many cases, each base station is divided into "sectors." In perhaps the most common configuration, a hexagonally shaped cell is divided into three 120° sectors, and each sector is served by one or more base station antennas that have an azimuth Half Power Beamwidth (HPBW) of approximately 65°. Typically, the base station antennas are mounted on a tower or other raised structure, with the radiation patterns (also referred to herein as "antenna beams") that are generated by the base station antennas directed outwardly. Base station antennas are often implemented as linear or planar phased arrays of radiating elements.

In order to accommodate the ever-increasing volume of cellular communications, cellular operators have added cellular service in a variety of new frequency bands. While in some cases it is possible to use linear arrays of so-called "wide-band" or "ultra wide-band" radiating elements to provide service in multiple frequency bands, in other cases it is necessary to use different linear arrays (or planar arrays) of radiating elements to support service in the different frequency bands. In the early years of cellular communications, each linear array was typically implemented as a separate base station antenna.

As the number of frequency bands has proliferated, and increased sectorization has become more common (e.g., dividing a cell into six, nine or even twelve sectors), the number of base station antennas deployed at a typical base station has increased significantly. However, due to, for example, local zoning ordinances and/or weight and wind loading constraints for the antenna towers, there is often a limit as to the number of base station antennas that can be deployed at a given base station. In order to increase capacity without further increasing the number of base station antennas, so-called multi-band base station antennas have been introduced in recent years in which multiple linear arrays of radiating elements are included in a single antenna. One very common multi-band base station antenna design is the RVV antenna, which includes one linear array of "low-band" radiating elements that are used to provide service in some or all of the 694-960 MHz frequency band (which is often referred to as the "R-band") and two linear arrays of "high-band" radiating elements that are used to provide service in some or all of the 1695-2690 MHz frequency band (which is often referred to as the "V-band"). These linear arrays are mounted in side-by-side fashion.

There is also significant interest in RRVV base station antennas, which refer to base station antennas having two linear arrays of low-band radiating elements and two (or four) linear arrays of high-band radiating elements. RRVV antennas are used in a variety of applications including 4×4 multi-input-multi-output ("MIMO") applications or as multi-band antennas having two different low-bands (e.g., a 700 MHz low-band linear array and an 800 MHz low-band linear array) and two different high bands (e.g., an 1800 MHz high-band linear array and a 2100 MHz high-band linear array). RRVV antennas, however, are challenging to implement in a commercially acceptable manner because achieving a 65° azimuth HPBW antenna beam in the low-band typically requires low-band radiating elements that are at least 200 mm wide. When two low-band arrays are placed side-by-side, with high-band linear arrays arranged therebetween, this results in a base station antenna having a width of perhaps 600-760 mm. Such a large antenna may have very high wind loading, may be very heavy, and/or may be expensive to manufacture. Operators would prefer RRVV base station antennas having widths in the 300-380 mm range which is a typical width for state-of-the-art base station antennas.

SUMMARY

Pursuant to embodiments of the present invention, dual-polarized radiating elements are provided that include a first dipole that extends along a first axis, the first dipole including a first dipole arm and a second dipole arm and a second dipole that extends along a second axis, the second dipole including a third dipole arm and a fourth dipole arm. The second axis is generally perpendicular to the first axis. Each of the first through fourth dipole arms has first and second spaced-apart conductive segments that together form a generally oval shape.

The dual-polarized radiating elements may also include at least one feed stalk that extends generally perpendicular to a plane defined by the first and second dipoles.

In some embodiments, distal ends of the first and second conductive segments of the first dipole arm are electrically connected to each other so that the first dipole arm has a closed loop structure. In other embodiments, a distal end of the first conductive segment of the first dipole arm is spaced-apart from a distal end of the second conductive segment of the first dipole arm so that the first and second conductive segments of the first dipole arm are only electrically connected to each other through proximate ends of the first and second conductive segments of the first dipole arm.

In some embodiments, each of the first and second conductive segments of the first through fourth dipole arms includes a first widened section that has a first average width, a second widened section that has a second average width and a narrowed section that has a third average width, the narrowed section being between the first widened section and the second widened section. In these embodiments, the third average width may be less than half the first average width and less than half the second average width. The narrowed section may comprise a meandered conductive trace. The narrowed section may create a high impedance for currents that are at a frequency that is approximately twice the highest frequency in the operating frequency range of the dual-polarized radiating element.

In some embodiments, a combined surface area of the first and second conductive segments that form the first dipole arm is greater than a combined surface area of the first and second conductive segments that form the second dipole arm. In such embodiments, the dual-polarized radiating element may be mounted on a base station antenna, and the first dipole arm is closer to a side edge of the base station antenna than is the second dipole arm.

In some embodiments, the first and second conductive segments of each dipole arm may comprise conductive segments of a printed circuit board.

In some embodiments, at least half of an area between the first and second conductive segments of the first dipole arm may be open area.

In some embodiments, a first meandered trace of the first conductive segment of the first dipole arm and a second meandered trace of the second conductive segment of the first dipole arm extend into an interior section of the first dipole arm that is between the first and second conductive segments of the first dipole arm. In some embodiments, all of the meandered trace segments on the first dipole arm extend towards an interior section of the first dipole arm that is between the first and second conductive segments of the first dipole arm.

In some embodiments, the first dipole directly radiates radio frequency ("RF") signals at a +45° polarization and the second dipole directly radiates RF signals at a −45° polarization.

In some embodiments, a conductive plate is mounted above central portions of the first and second dipoles. In some embodiments, the conductive plate may be positioned within a distance of 0.05 times an operating wavelength of the first and second dipoles, where the operating wavelength is the wavelength corresponding to the center frequency of an operating frequency band of the dual-polarized radiating element.

Pursuant to further embodiments of the present invention, dual-polarized radiating elements are provided that include a first dipole that extends along a first axis, the first dipole including a first dipole arm and a second dipole arm, and a second dipole that extends along a second axis, the second dipole including a third dipole arm and a fourth dipole arm and the second axis being generally perpendicular to the first axis. Each of the first through fourth dipole arms has first and second spaced apart-current paths, and central portions of each of the first and second spaced apart-current paths of the first and second dipole arms extend in parallel to the first axis, and central portions of each of the first and second spaced apart-current paths of the third and fourth dipole arms extend in parallel to the second axis.

In some embodiments, each of the first through fourth dipole arms has first and second spaced-apart conductive segments, and the first current path is along the first conductive segment and the second current path is along the second conductive segment.

In some embodiments, the first and second spaced-apart conductive segments on each of the first through fourth dipole arms together form a generally oval shape. In other embodiments, the first and second spaced-apart conductive segments on each of the first through fourth dipole arms together form a generally rectangular shape.

In some embodiments, each of the first and second conductive segments of the first through fourth dipole arms includes a first widened section that has a first average width, a second widened section that has a second average width and a narrowed section that has a third average width, the narrowed section being between the first widened section and the second widened section. In these embodiments, the third average width may be less than half the first average width and less than half the second average width. The narrowed section may create a high impedance for currents that are at a frequency that is approximately twice the highest frequency in the operating frequency range of the dual-polarized radiating element. The narrowed section may be a meandered conductive trace.

In some embodiments, a combined surface area of the first and second conductive segments that form the first dipole arm is greater than a combined surface area of the first and second conductive segments that form the second dipole arm. In such embodiments, the dual-polarized radiating element may be mounted on the base station antenna, and the first dipole arm may be closer to a side edge of a base station antenna than the second dipole arm.

In some embodiments, the first conductive segment of the first dipole arm includes a first meandered trace and the second conductive segment of the first dipole arm includes a second meandered trace, and the first and second meandered traces extend into an interior section of the first dipole arm that is between the first and second conductive segments of the first dipole arm. In some embodiments, the first and second conductive segments of the first dipole arm together include a plurality of meandered trace segments, and all of the meandered trace segments included in the first and second conductive segments of the first dipole arm extend towards an interior section of the first dipole arm that is between the first and second conductive segments of the first dipole arm.

In some embodiments, distal ends of the first and second conductive segments of the first dipole arm are electrically connected to each other so that the first dipole arm has a closed loop structure. For example, the distal ends of the first and second conductive segments of the first dipole arm are electrically connected to each other by a meandered conductive trace. In other embodiments, a distal end of the first conductive segment of the first dipole arm is spaced-apart from a distal end of the second conductive segment of the first dipole arm so that the first and second conductive segments of the first dipole arm are only electrically connected to each other through proximate ends of the first and second conductive segments of the first dipole arm.

Pursuant to still further embodiments of the present invention, dual-polarized radiating elements for base station antennas are provided that include a first dipole that extends along a first axis, the first dipole including a first dipole arm and a second dipole arm and a second dipole that extends along a second axis, the second dipole including a third dipole arm and a fourth dipole arm and the second axis being generally perpendicular to the first axis. Each of the first through fourth dipole arms has first and second spaced-apart conductive segments that define respective first and second current paths, and each of the first and second conductive segments of the first through fourth dipole arms includes a plurality of widened sections and a plurality of narrowed meandered trace sections that are between adjacent ones of the widened sections. A first of the widened sections of the first dipole arm is wider than a first of the widened sections of the second dipole arm that is at the same distance from a point where the first and second axes cross as is the first of the widened sections of the first dipole arm.

Pursuant to yet additional embodiments of the present invention, methods of tuning a base station antenna are provided. The base station antenna may include a first linear array of radiating elements that transmit and receive signals within an operating frequency band and a second linear array of radiating elements that transmit and receive signals within the operating frequency band, each of the radiating elements including first through fourth dipole arms. The operating frequency band has at least a first sub-band in a first frequency range and a second sub-band in a second frequency range, the first and second sub-bands separated by a third frequency band that is not part of the operating frequency band. Pursuant to these methods, sizes of respective gaps between adjacent ones of the first through fourth dipole arms on the respective radiating elements may be selected in order to tune a common mode resonance that is generated on the second linear array when the first linear array transmits signals to be within the third frequency band.

In some embodiments, the first and second sub-bands are both within the 694-960 MHz frequency band. In some embodiments, the third frequency band is the 799-823 MHz frequency band.

In yet additional embodiments of the present invention, base station antennas are provided that include a first linear array of radiating elements that transmit and receive signals within an operating frequency band and a second linear array of radiating elements that transmit and receive signals within the operating frequency band. Each of the radiating elements in the first and second linear arrays of radiating elements includes a first dipole and a second dipole that extend in perpendicular planes and a conductive plate is mounted above central portions of the first and second dipoles. The conductive plate is positioned within a distance of 0.05 times an operating wavelength of the first and second dipoles, where the operating wavelength is the wavelength corresponding to the center frequency of the operating frequency band.

In some embodiments, the conductive plates are configured to shift a frequency of a common mode resonance that is within an operating frequency band of the first and second linear arrays and that is generated on the second linear array when the first linear array transmits signals so that the common mode resonance falls outside the operating frequency band.

DETAILED DESCRIPTION

Figure 1:
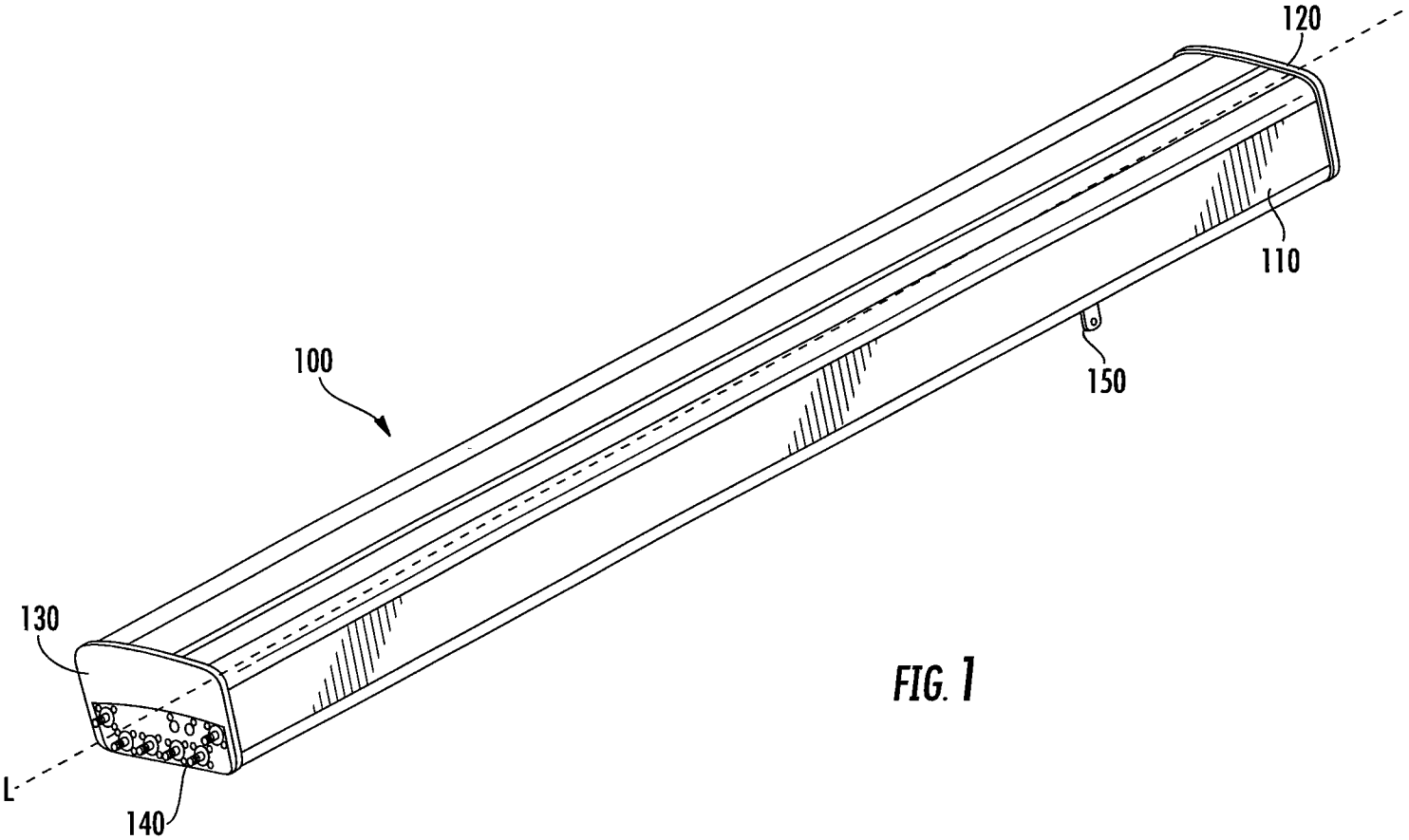
FIG. 1 is a side perspective view of a base station antenna according to embodiments of the present invention.

Embodiments of the present invention relate generally to dual-polarized low-band radiating elements for a dual-band base station antenna and to related base station antennas and methods. Such dual-band antennas may be capable of supporting two or more major air-interface standards in two or more cellular frequency bands and allow wireless operators to reduce the number of antennas deployed at base stations, lowering tower leasing costs while increasing speed to market capability.

A challenge in the design of dual-band base station antennas is reducing the effect of scattering of the RF signals at one frequency band by the radiating elements of the other frequency band. Scattering is undesirable as it may affect the shape of the antenna beam in both the azimuth and elevation planes, and the effects may vary significantly with frequency, which may make it hard to compensate for these effects using other techniques. Moreover, at least in the azimuth plane, scattering tends to impact the beamwidth, beam shape, pointing angle, gain and front-to-back ratio in undesirable ways. The low-band radiating elements according to certain embodiments of the present invention may be designed to have reduced impact on the antenna pattern of closely located high-band radiating elements (i.e., reduced scattering).

Pursuant to embodiments of the present invention, base station antennas are provided that have cross-dipole dual polarized radiating elements that include first and second dipoles that extend along respective first and second perpendicular axes. Each dipole may include a pair of dipole arms. Each dipole arm has first and second spaced-apart conductive segments that together form a generally oval shape or a generally elongated rectangular shape. The first and second spaced-apart conductive segments of each dipole arm may include central portions that extend in parallel to the axis of their respective dipoles. The first dipole may directly radiate RF signals at a +45° polarization and the second dipole may directly radiate RF signals at a −45° polarization.

In some embodiments, distal ends of the first and second conductive segments of each dipole arm may be electrically connected to each other so that each dipole arm each has a closed loop structure. Each of the first and second conductive segments may include a plurality of widened sections and narrowed meandered conductive trace sections that connect adjacent ones of the widened sections. The narrowed meandered conductive trace sections may create a high impedance for currents that are, for example, at frequencies that are approximately twice the highest frequency in the operating frequency range of the dual-polarized radiating element.

In some embodiments, the dipoles may be unbalanced such that a combined surface area of the first and second conductive segments that form the first dipole arm is greater than a combined surface area of the first and second conductive segments that form the second dipole arm. The dipole arm that has less conductive material may be the inner dipole arm of the dipole that is closer to the middle of the antenna.

The dipole arms may be implemented, for example, on a printed circuit board or other generally planar substrate. The cross-dipole dual polarized radiating elements according to embodiments of the present invention may further include feed stalks which may be implemented, for example, on printed circuit boards. In some embodiments, the feed stalks may support the dipole arms above a backplane such as a reflector.

In some embodiments, the dual polarized radiating elements may be included in a base station antenna and used to form first and second linear arrays. Each dual polarized radiating element include a conductive plate that may be positioned within a distance of 0.15 times an operating wavelength of the dipoles and may be generally parallel to the dipoles. In other embodiments, the conductive plate may be positioned within a distance of 0.1 times the operating wavelength of the dipoles or within 0.05 times the operating wavelength of the dipoles. The conductive plates may be configured to shift a frequency of a common mode resonance that is within an operating frequency band of the first and second linear arrays and that is generated on radiating elements of the second linear array when the first linear array transmits signals. The frequency of the common mode resonance may be shifted to fall outside the operating frequency band.

Pursuant to further embodiments of the present invention, methods of tuning a base station antenna are provided. The base station antenna may have a first linear array of radiating elements that transmit and receive signals within an operating frequency band and a second linear array of radiating elements that transmit and receive signals within the operating frequency band. Each of the radiating elements may include first through fourth dipole arms, and the operating frequency band may have at least a first sub-band in a first frequency range and a second sub-band in a second frequency range, and the first and second sub-bands may be separated by a third frequency band that is not part of the operating frequency band. Pursuant to the methods according to embodiments of the present invention, widths of respective gaps between adjacent ones of the first through fourth dipole arms on the respective radiating elements may be selected in order to tune a common mode resonance that is generated on the second linear array when the first linear array transmits signals to be within the third frequency band. In some embodiments, the first and second sub-bands are both within the 694-960 MHz frequency band, and the third frequency band is the 799-823 MHz frequency band.

Embodiments of the present invention will now be described in further detail with reference to the attached figures.

Figure 2:
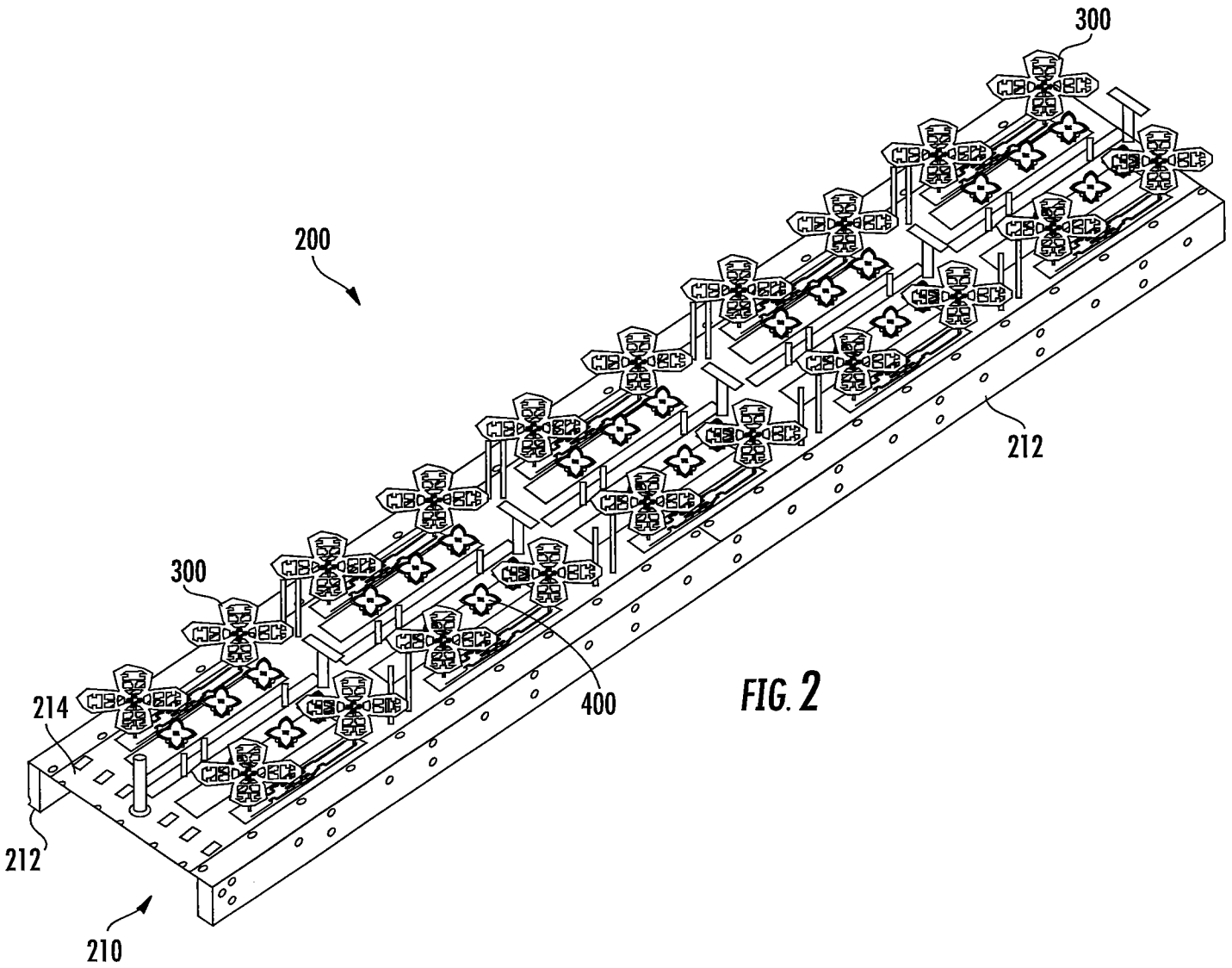
FIG. 2 is a perspective view of the base station antenna of FIG. 1 with the radome removed.
Figure 3:
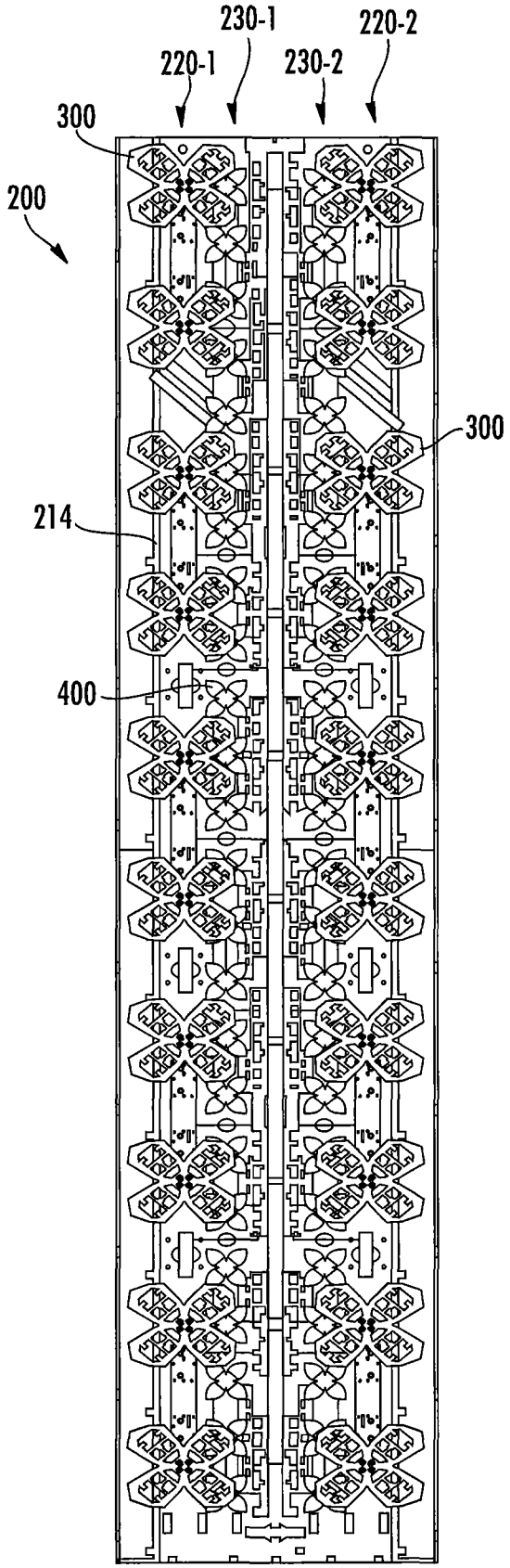
FIG. 3 is a front view of the base station antenna of FIG. 1 with the radome removed.
Figure 4:
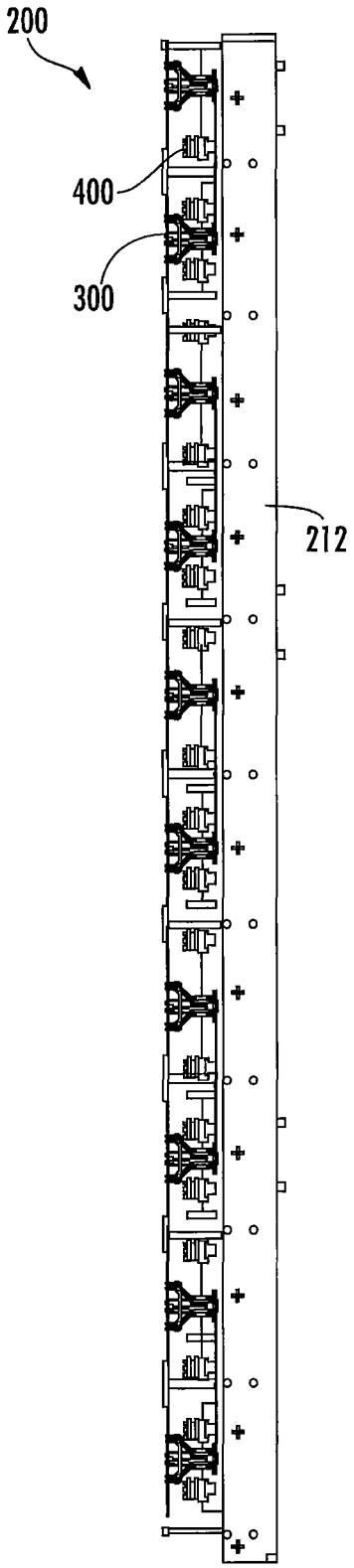
FIG. 4 is a side view of the base station antenna of FIG. 1 with the radome removed.
Figure 5:
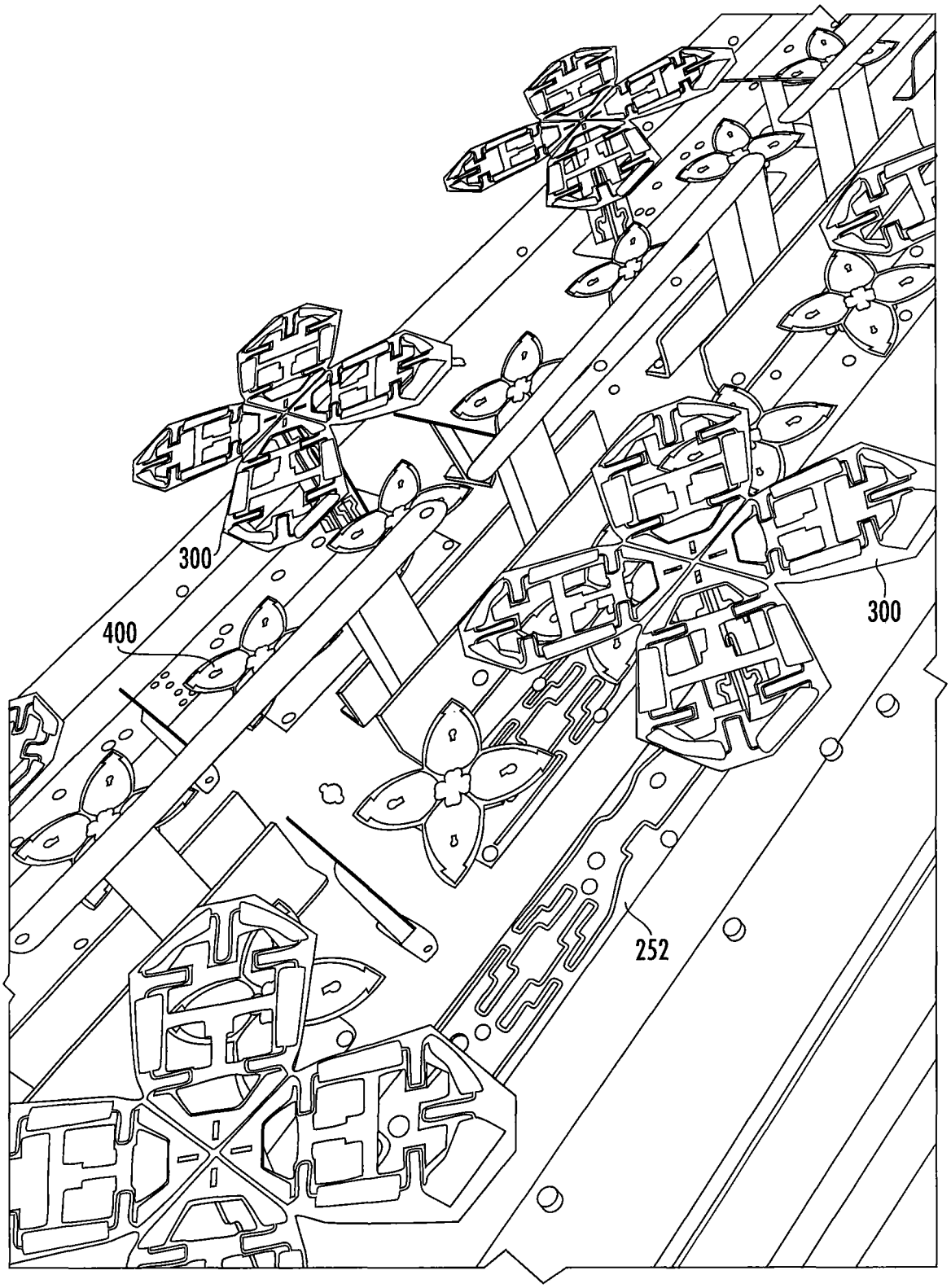
FIGS. 5 and 6 are enlarged perspective views of various portions of the base station antenna of FIGS. 1-4.
Figure 6:
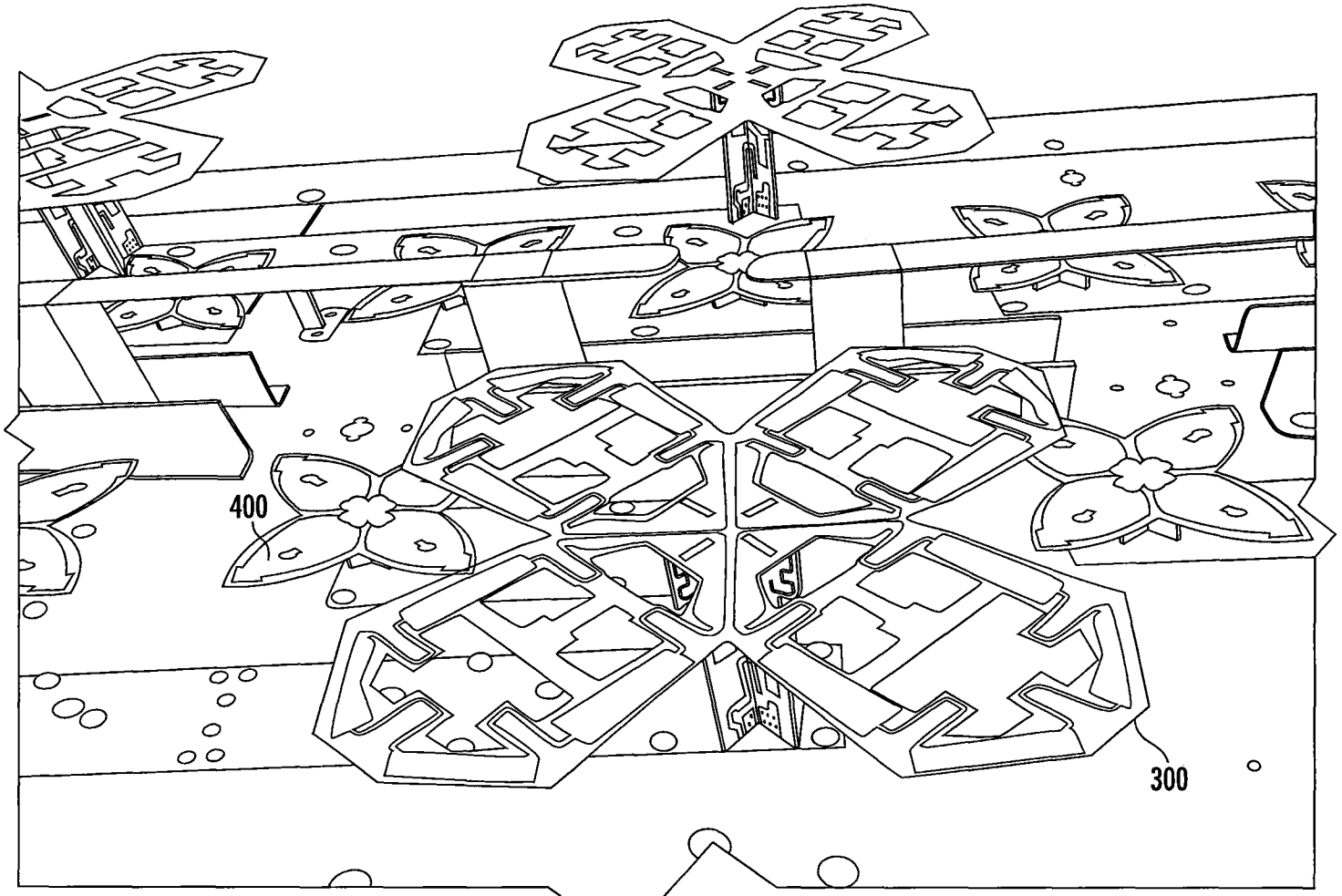
Figure 7:
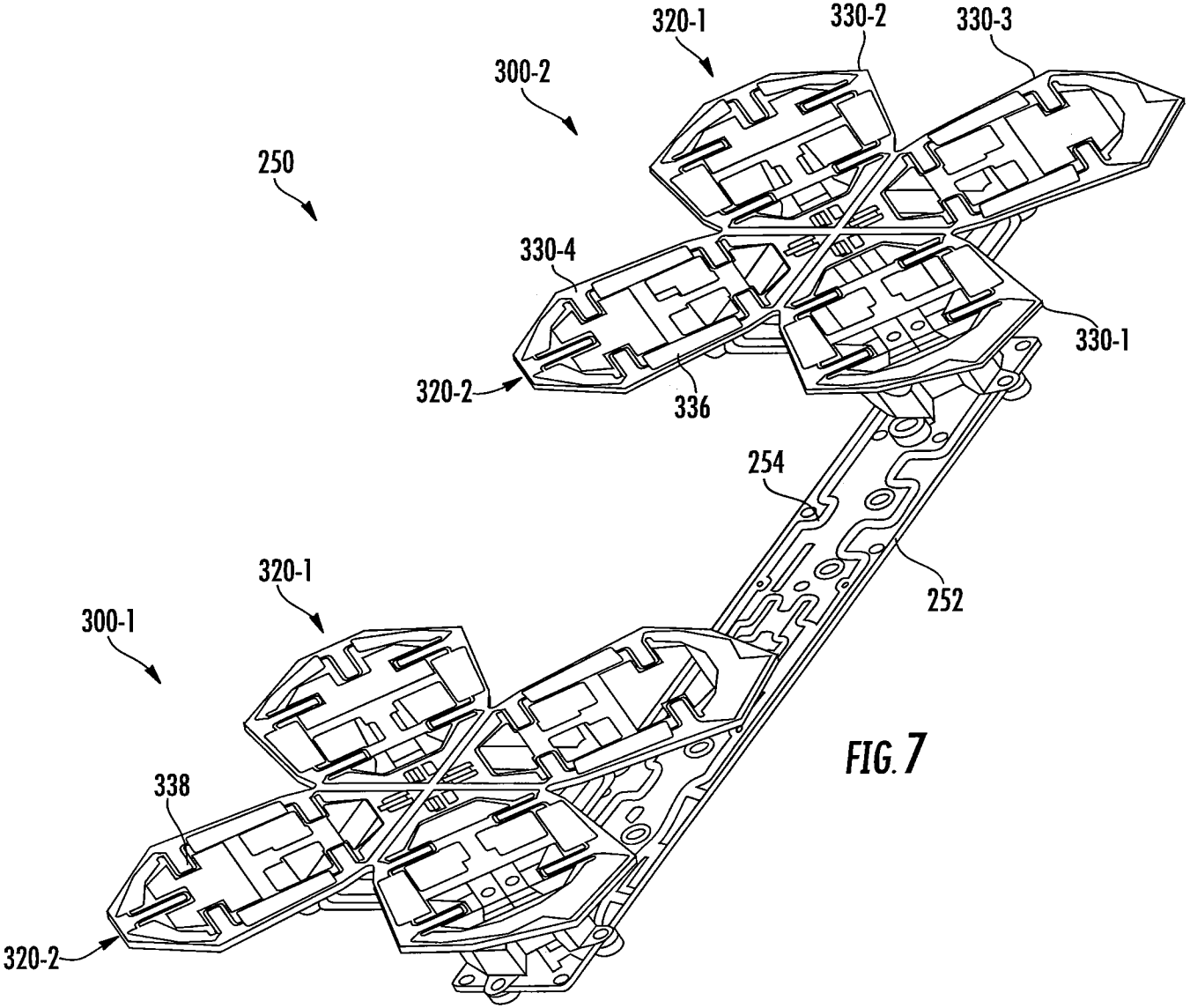
FIG. 7 is an enlarged perspective view of one of the low-band radiating element assemblies of the base station antenna of FIGS. 1-6.
Figure 8:
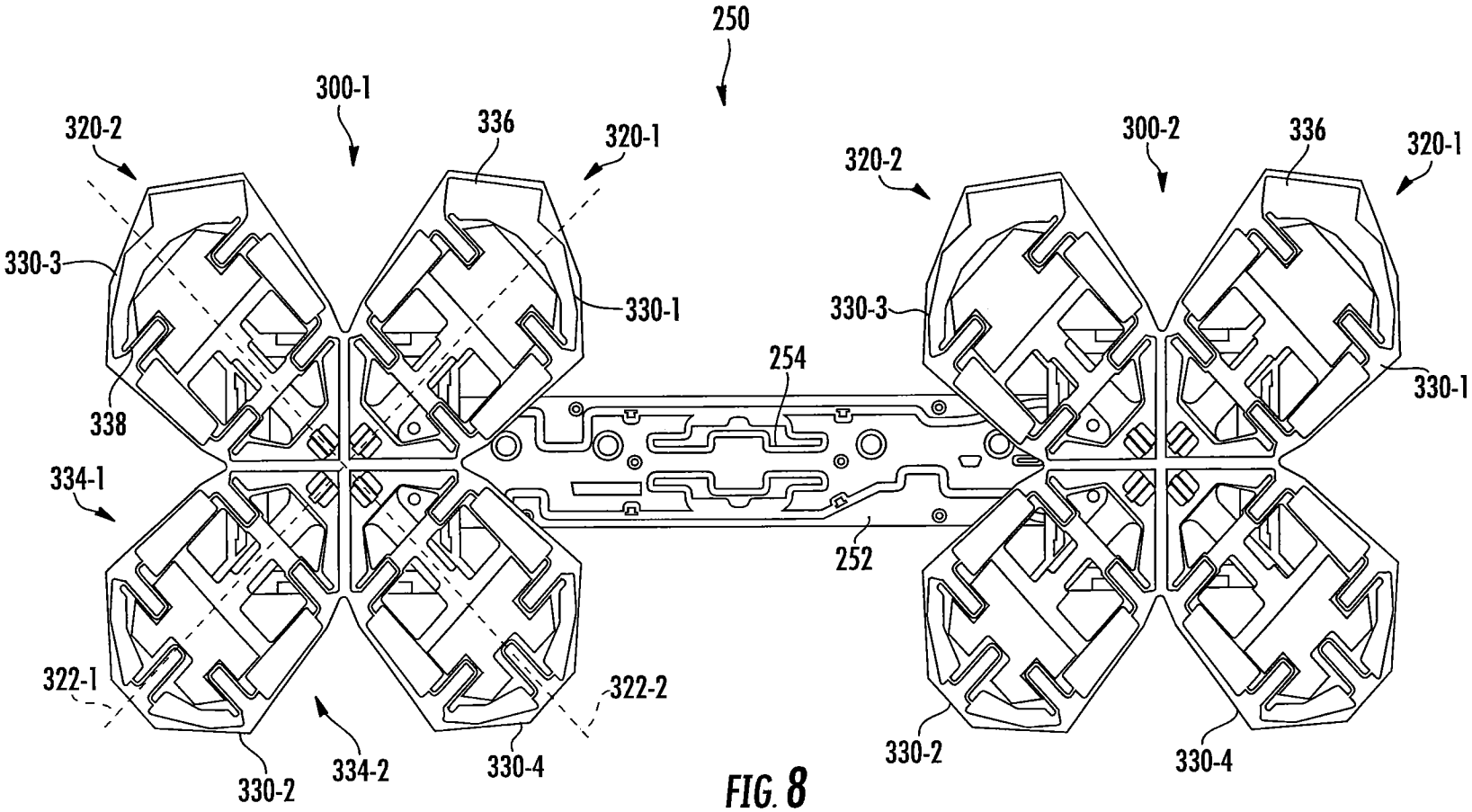
FIG. 8 is a top view of the low-band radiating element assembly of FIG. 7.
Figure 9:
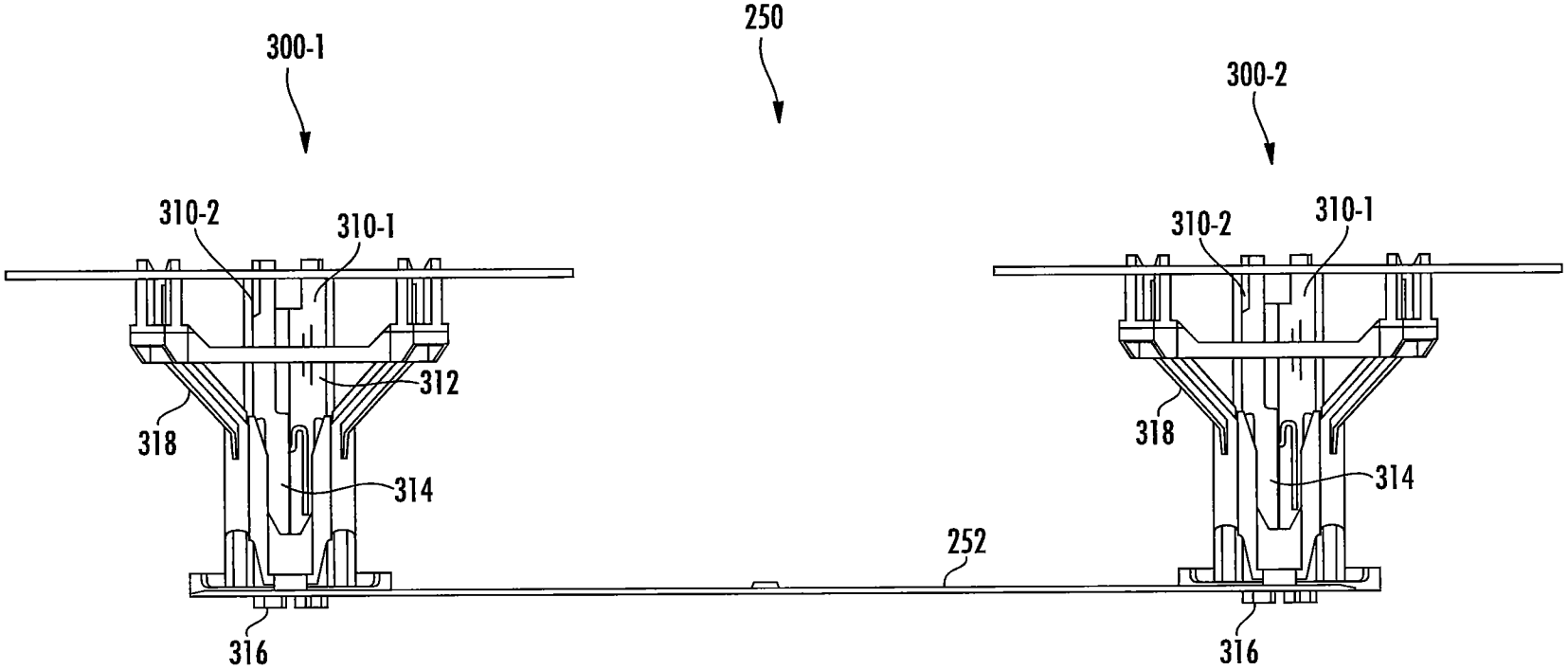
FIG. 9 is a side view of the low-band radiating element assembly of FIG. 7.
Figure 10:
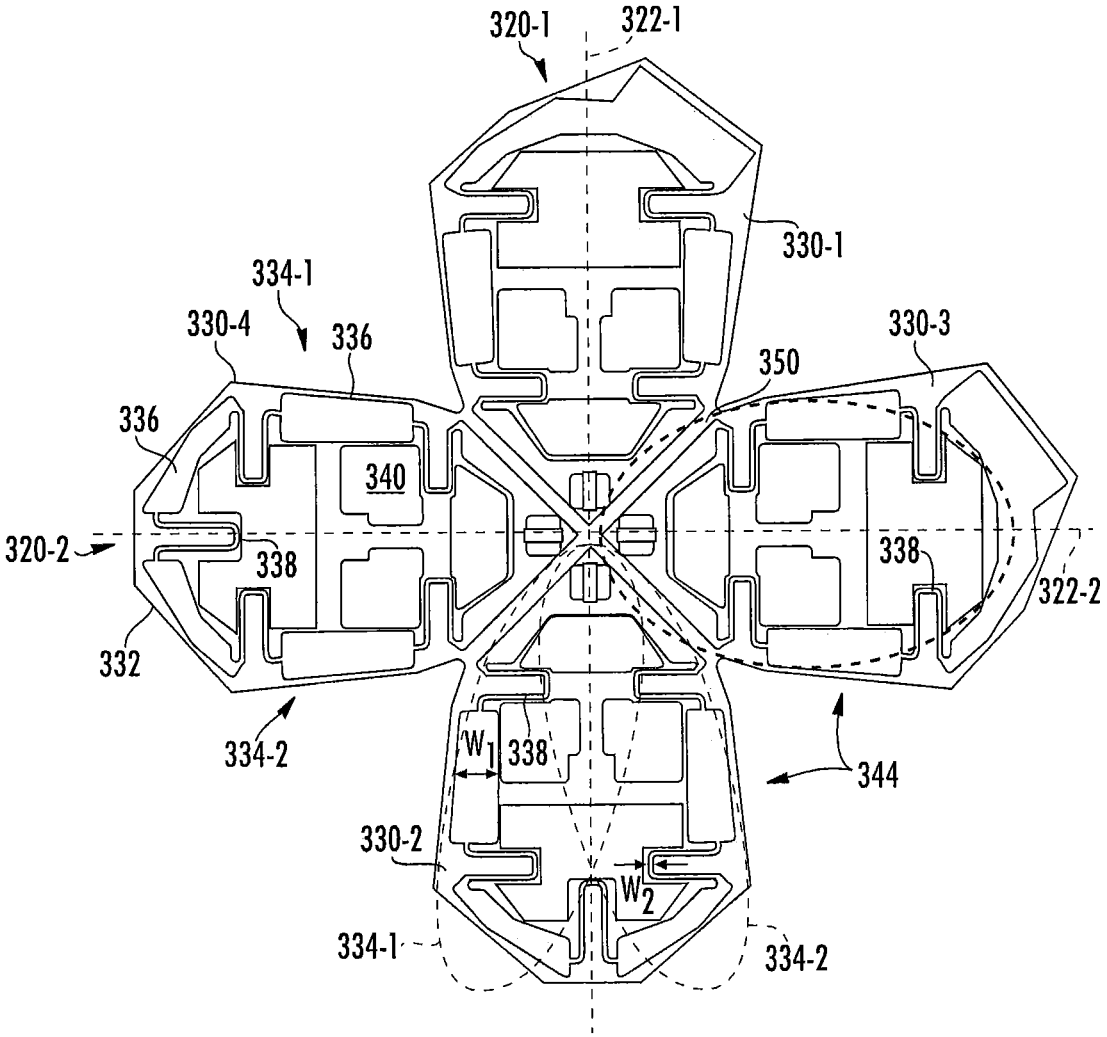
FIG. 10 is a top view illustrating the dipoles of one of the low-band radiating elements included in the low-band radiating element assembly of FIGS. 7-9.
Figure 11:
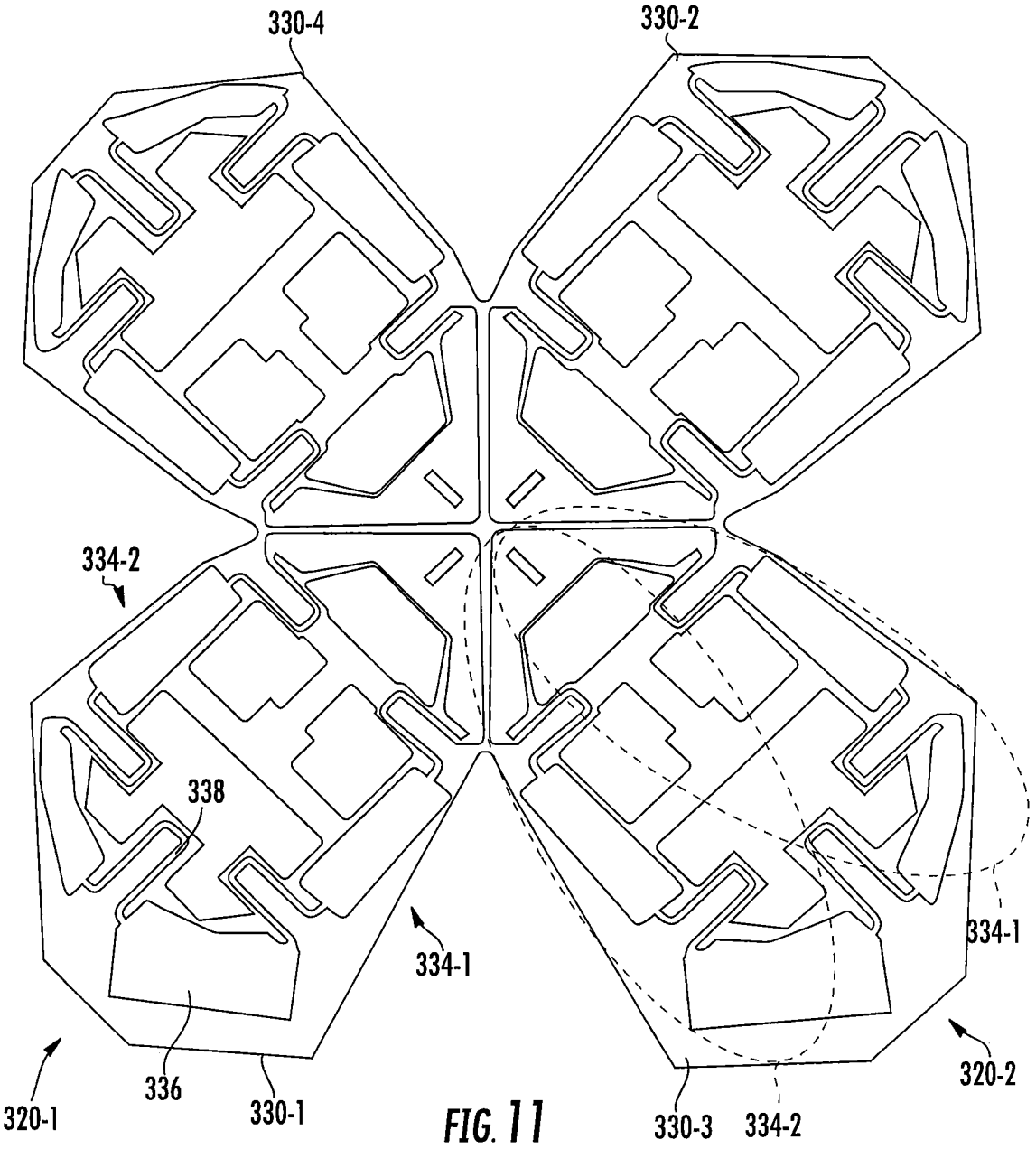
FIG. 11 is a top view illustrating the dipoles of a low-band radiating element according to further embodiments of the present invention.
Figure 12:
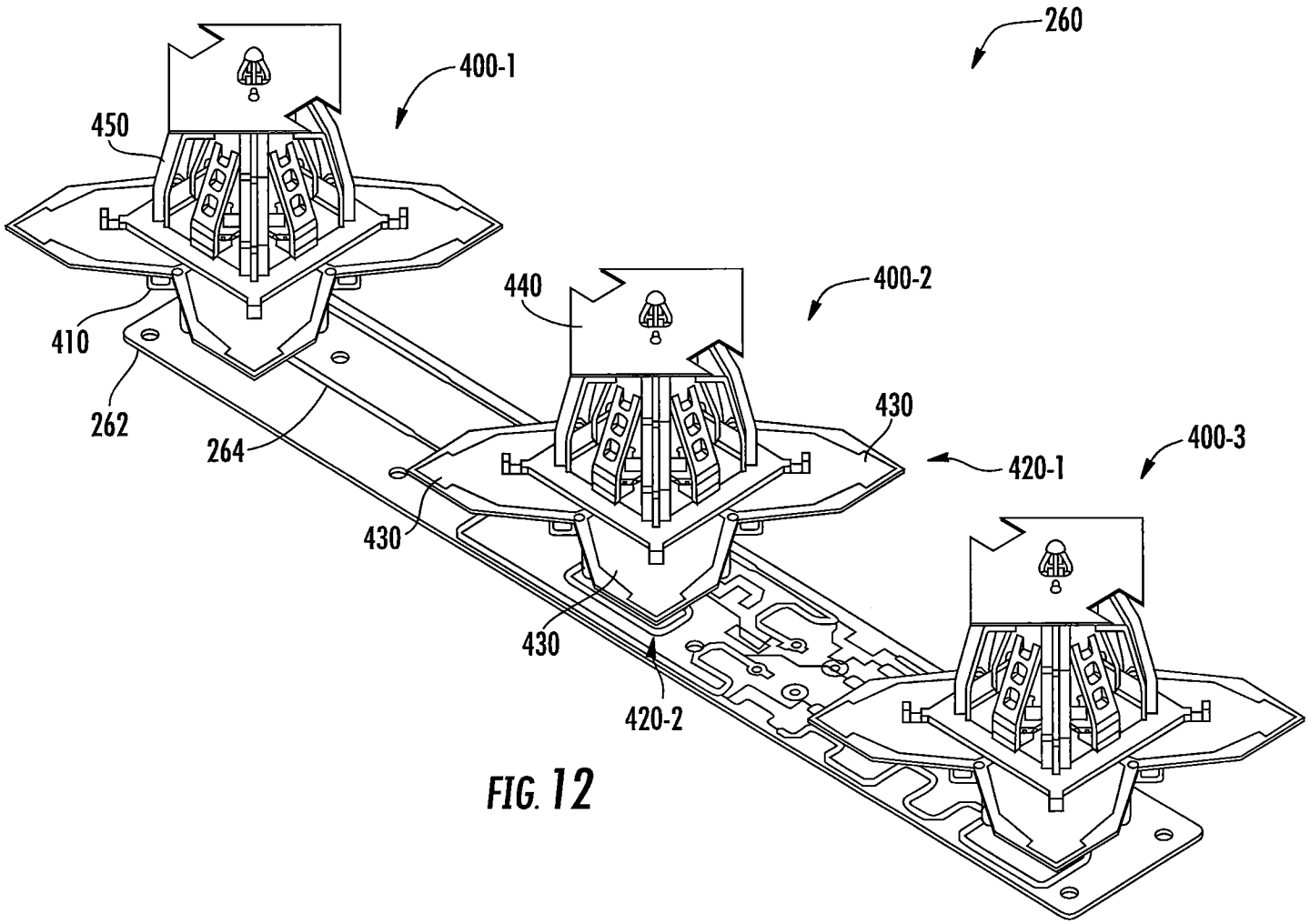
FIG. 12 is an enlarged perspective view of one of the high-band radiating element assemblies of the base station antenna of FIGS. 1-6.

FIGS. 1-6 illustrate a base station antenna 100 according to certain embodiments of the present invention. In particular, FIG. 1 is a front perspective view of the antenna 100, while FIGS. 2-4 are a perspective view, a front view and side view, respectively, of the antenna 100 with the radome thereof removed to illustrate the inner components of the antenna. FIGS. 5 and 6 are enlarged partial perspective views of the base station antenna 100. FIGS. 7-9 are a perspective view, a front view and a side view, respectively, of one of the low-band radiating element assemblies included in the base station antenna 100. FIG. 10 is a top view illustrating the dipoles of one of the low-band radiating elements included in the low-band radiating element assembly of FIGS. 7-9. Finally, FIG. 12 is a top view illustrating the dipoles of one of the high-band radiating element assemblies included in the base station antenna 100. FIG. 11 is a top view illustrating an alternative design for the dipoles of the low-band radiating elements.

As shown in FIGS. 1-6, the base station antenna 100 is an elongated structure that extends along a longitudinal axis L. The base station antenna 100 may have a tubular shape with generally rectangular cross-section. The antenna 100 includes a radome 110 and a top end cap 120. In some embodiments, the radome 110 and the top end cap 120 may comprise a single integral unit, which may be helpful for waterproofing the antenna 100. One or more mounting brackets 150 are provided on the rear side of the radome 110 which may be used to mount the antenna 100 onto an antenna mount (not shown) on, for example, an antenna tower. The antenna 100 also includes a bottom end cap 130 which includes a plurality of connectors 140 mounted therein. The antenna 100 is typically mounted in a vertical configuration (i.e., the longitudinal axis L may be generally perpendicular to a plane defined by the horizon when the antenna 100 is mounted for normal operation).

FIGS. 2-4 are a perspective view, a front view and a side view, respectively, of the base station antenna 100 of FIG. 1 with the radome 110 removed.

As shown in FIGS. 2-4, the base station antenna 100 includes an antenna assembly 200 that may be slidably inserted into the radome 110 from either the top or bottom before the top cap 120 or bottom cap 130 are attached to the radome 110.

The antenna assembly 200 includes a ground plane structure 210 that has sidewalls 212 and a reflector surface 214. Various mechanical and electronic components of the antenna may be mounted in the chamber defined between the sidewalls 212 and the back side of the reflector surface 214 such as, for example, phase shifters, remote electronic tilt ("RET") units, mechanical linkages, a controller, diplexers, and the like. The ground plane structure 210 may not include a back wall to expose the electrical and mechanical components. The reflector surface 214 of the ground plane structure 210 may comprise or include a metallic surface that serves as a reflector and ground plane for the radiating elements of the antenna 100. Herein the reflector surface 214 may also be referred to as the reflector 214.

A plurality of radiating elements 300, 400 are mounted on the reflector surface 214 of the ground plane structure 210. The radiating elements include low-band radiating elements 300 and high-band radiating elements 400. As shown best in FIG. 3, the low-band radiating elements 300 are mounted in two vertical columns to form two vertically-disposed linear arrays 220-1, 220-2 of low-band radiating elements 300. Each linear array 220 may extend along substantially the full length of the antenna 100 in some embodiments. The high-band radiating elements 400 may likewise be mounted in two vertical columns to form two vertically-disposed linear arrays 230-1, 230-2 of high-band radiating elements 400. In other embodiments, the high-band radiating elements 400 may be mounted in multiple rows and columns to form more than two linear arrays 230. The linear arrays 230 of high-band radiating elements 400 may be positioned between the linear arrays 220 low-band radiating elements 300. The linear arrays 230 of high-band radiating elements 400 may or may not extend the full length of the antenna 100. The low-band radiating elements 300 may be configured to transmit and receive signals in a first frequency band. In some embodiments, the first frequency band may comprise the 694-960 MHz frequency range or a portion thereof. The high-band radiating elements 400 may be configured to transmit and receive signals in a second frequency band. In some embodiments, the second frequency band may comprise the 1695-2690 MHz frequency range or a portion thereof.

FIGS. 5-6 are enlarged perspective views of portions of the base station antenna 100 with the radome 110 removed that illustrates several of the low-band radiating elements 300 and several of the high-band radiating elements 400 in greater detail. As can be seen in FIGS. 5-6, many of the low-band radiating elements 300 are located in very close proximity to several of the high-band radiating elements 400. The low-band radiating elements 300 are taller (above the reflector 214) than the high-band radiating elements 400 and may extend over at least one high-band radiating element 400.

Note that the antenna 100 and antenna assembly 200 are described using terms that assume that the antenna 100 is mounted for use on a tower with the longitudinal axis of the antenna 100 extending along a vertical axis and the front surface of the antenna 100 mounted opposite the tower pointing toward the coverage area for the antenna 100. In contrast, the individual components of the antenna 100 such as the radiating elements 300, 400 and various other components may be described using terms that assume that the antenna assembly 200 is mounted on a horizontal surface with the radiating elements 300, 400 extending upwardly. Thus, while, for example, the dipole arms 330 of the low band radiating elements 300 will be described as being the top portion of the radiating element 300 and as being above the reflector 214, it will be appreciated that when the antenna 100 is mounted for use the dipole arms 330 will point forwardly from the ground plane structure 210 as opposed to upwardly.

The low-band radiating elements 300 and the high-band radiating elements 400 are mounted on the ground plane structure 210. The reflector surface 214 of the ground plane structure 210 may comprise a sheet of metal that, as noted above, serves as a reflector and as a ground plane for the radiating elements 300, 400.

As noted above, the low band and high band radiating elements 300, 400 are arranged as two low-band arrays 220 and two high-band arrays 230 of radiating elements. Each array 220, 230 may be used to form a separate antenna beam. Each radiating element 300 in the first low-band array 220-1 may be horizontally aligned with a respective radiating element 300 in the second low-band array 220-2. Likewise, each radiating element 400 in the first high-band array 230-1 may be horizontally aligned with a respective radiating element 400 in the second high-band array 230-2. Each low-band linear array 220 may include a plurality of low-band radiating element feed assemblies 250, each of which includes two low-band radiating elements 300. Each high-band linear array 230 may include a plurality of high-band radiating element feed assemblies 260, each of which includes one to three high-band radiating elements 400.

Referring now to FIGS. 7-9, one of the low-band radiating element feed assemblies 250 will be described in greater detail. The low-band radiating element feed assembly 250 includes a printed circuit board 252 that has first and second low-band radiating elements 300-1, 300-2 extending upwardly from either end thereof. The printed circuit board 252 includes RF transmission line feeds 254 that provide RF signals to, and receive RF signals from, the respective low-band radiating elements 300-1, 300-2. Each low-band radiating element 300 includes a pair of feed stalks 310, and first and second dipoles 320-1, 320-2. The first dipole 320-1 includes first and second dipole arms 330-1, 330-2, and the second dipole 320-2 includes third and fourth dipole arms 330-3, 330-4.

The feed stalks 310 may each comprise a printed circuit board that has RF transmission lines 314 formed thereon. These RF transmission lines 314 carry RF signals between the printed circuit board 252 and the dipoles 320. Each feed stalk 310 may further include a hook balun. A first of the feed stalks 310-1 may include a lower vertical slit and the second of the feed stalks 310-2 includes an upper vertical slit. These vertical slits allow the two feed stalks 310 to be assembled together to form a vertically extending column that has generally x-shaped horizontal cross-sections. Lower portions of each printed circuit board may include plated projections 316. These plated projections 316 are inserted through slits in the printed circuit board 252. The plated projections 316 may be soldered to plated portions on printed circuit board 252 that are adjacent the slits in the printed circuit board 252 to electrically connect the feed stalks 310 to the printed circuit board 252. The RF transmission lines 314 on the respective feed stalks 310 may center feed the dipoles 320-1, 320-2 via direct ohmic connections between the transmission lines 314 and the dipole arms 330.

Dipole supports 318 may also be provided to hold the first and second dipoles 320-1, 320-2 in their proper positions and reduce the forces applied to the solder joints that electrically connect the dipoles 320 to their feed stalks 310.

The azimuth half power beamwidths of each low-band radiating element 300 may be in the range of 55 degrees to 85 degrees. In some embodiments, the azimuth half power beamwidth of each low-band radiating element 300 may be approximately 65 degrees.

Each dipole 320 may include, for example, two dipole arms 330 that are between approximately 0.2 to 0.35 of an operating wavelength in length, where the "operating wavelength" refers to the wavelength corresponding to the center frequency of the operating frequency band of the radiating element 300. For example, if the low-band radiating elements 300 are designed as wideband radiating elements that are used to transmit and receive signals across the full 694-960 MHz frequency band, then the center frequency of the operating frequency band would be 827 MHz and the corresponding operating wavelength would be 36.25 cm.

As shown in FIG. 8, the first dipole 320-1 extends along a first axis 322-1 and the second dipole 320-2 that extends along a second axis 322-2 that is generally perpendicular to the first axis 322-1. Consequently, the first and second dipoles 320-1, 320-2 are arranged in the general shape of a cross. Dipole arms 330-1 and 330-2 of first dipole 320-1 are center fed by a common RF transmission line 314 and radiate together at a first polarization. In the depicted embodiment, the first dipole 320-1 is designed to transmit signals having a +45 degree polarization. Dipole arms 330-3 and 330-4 of second dipole 320-2 are likewise center fed by a common RF transmission line 314 and radiate together at a second polarization that is orthogonal to the first polarization. The second dipole 320-2 is designed to transmit signals having a −45 degree polarization. The dipole arms 330 may be mounted approximately 3/16 to 1/4 an operating wavelength above the reflector 214 by the feed stalks 310. The reflector 214 may be immediately beneath the feed board printed circuit board 252.

As can best be seen in FIGS. 8 and 10, each dipole arm 330 includes first and second spaced-apart conductive segments 334-1, 334-2 that together form a generally oval shape. A bold dashed oval is superimposed on dipole arm 330-3 in FIG. 10 to illustrate the generally oval nature of the combination of conductive segments 334-1 and 334-2. In FIG. 10 first and second dashed ovals are also superimposed on dipole arm 330-2 that generally circle the respective first and second conductive segments 334-1, 334-2. The spaced-apart conductive segments 334-1, 334-2 may be implemented, for example, in a printed circuit board 332 and may lie in a first plane that is generally parallel to a plane defined by the underlying reflector 214 in some embodiments. All four dipole arms 330 may lie in this first plane. Each feed stalk 310 may extend in a direction that is generally perpendicular to the first plane.

Each conductive segment 334-1, 334-2 may comprise a metal pattern that has a plurality of widened segments 336 and at least one narrowed trace section 338. The first conductive segment 334-1 may form half of the generally oval shape and the second conductive segment 334-2 may form the other half of the generally oval shape. In the particular embodiment depicted in FIGS. 7-10, the portions of the conductive segments 334-1, 334-2 at the end of each dipole arm 330 that is closest to the center of each dipole 320 may have straight outer edges as opposed to curved configuration of a true oval. Likewise, the portions of the conductive segments 334-1, 334-2 at the distal end of each dipole arm 330 may also have straight or nearly straight outer edges. It will be appreciated that such approximations of an oval are considered to have a generally oval shape for purposes of this disclosure (e.g., an elongated hexagon has a generally oval shape).

As shown in FIG. 10, each widened section 336 of the conductive segments 334-1, 334-2 may have a respective width $W_1$ in the first plane, where the width $W_1$ is measured in a direction that is generally perpendicular to the direction of current flow along the respective widened section 336. The width $W_1$ of each widened section 336 need not be constant, and hence in some instances reference will be made to the average width of each widened section 336. The narrowed trace sections 338 may similarly have a respective width $W_2$ in the first plane, where the width $W_2$ is measured in a direction that is generally perpendicular to the direction of instantaneous current flow along the narrowed trace section 338. The width $W_2$ of each narrowed trace section 338 also need not be constant, and hence in some instances reference will be made to the average width of each narrowed trace section 338.

The narrowed trace sections 338 may be implemented as meandered conductive traces. Herein, a meandered conductive trace refers to a non-linear conductive trace that follows a meandered path to increase the path length thereof. Using meandered conductive trace sections 338 provides a convenient way to extend the length of the narrowed trace section 338 while still providing a relatively compact conductive trace section 334. As will be discussed below, these narrowed trace sections 338 may be provided to improve the performance of the dual band antenna 100.

The average width of each widened section 336 may be, for example, at least twice the average width of each narrowed trace section 338 in some embodiments. In other embodiments, the average width of each widened section 336 may be at least three times the average width of each narrowed trace section 338. In still other embodiments, the average width of each widened section 336 may be at least four times the average width of each narrowed trace section 338. In yet further embodiments, the average width of each widened section 336 may be at least five times the average width of each narrowed trace section 338.

The narrowed trace sections 338 may act as high impedance sections that are designed to interrupt currents in the high-band frequency range that could otherwise be induced on the dipole arms 330. In particular, when the high-band radiating elements 400 transmit and receive signals, the high-band RF signals may tend to induce currents on the dipole arms 330 of the low-band radiating elements 300. This can particularly be true when the low-band and high-band radiating elements 300, 400 are designed to operate in frequency bands having center frequencies that are separated by about a factor of two, as a low-band dipole arm 330 having a length that is a quarter wavelength of the low-band operating frequency will, in that case, have a length of approximately a half wavelength of the high-band operating frequency. The greater the extent that high-band currents are induced on the low-band dipole arms 330, the greater the impact on the characteristics of the radiation pattern of the linear arrays 230 of high-band radiating elements 400.

The narrowed trace sections 338 may be designed to act as high impedance sections that are designed to interrupt currents in the high-band that could otherwise be induced on the low-band dipole arms 330. The narrowed trace sections 338 may be designed to create this high impedance for high-band currents without significantly impacting the ability of the low-band currents to flow on the dipole arm 330. As such, the narrowed trace sections 338 may reduce induced high-band currents on the low-band radiating elements 300 and consequent disturbance to the antenna pattern of the high-band linear arrays 230. In some embodiments, the narrowed trace sections 338 may make the low-band radiating elements 300 almost invisible to the high-band radiating elements 400, and thus the low-band radiating elements 300 may not distort the high-band antenna patterns.

As can further be seen in FIGS. 7-10, in some embodiments, the distal ends of the conductive segments 334-1, 334-2 may be electrically connected to each other so that the conductive segments 334-1, 334-2 form a closed loop structure. In the depicted embodiment, some of the conductive segments 334-1, 334-2 are electrically connected to each other by a narrowed trace section 338, while in other embodiments the widened sections 336 at the distal ends of conductive segments 334-1, 334-2 may merge together. In yet other embodiments, different electrical connections may be used. In still other embodiments, the distal ends of the conductive segments 334-1, 334-2 may not be electrically connected to each other. As can also be seen, the interior of the loop defined by the conductive segments 334-1, 334-2 (which may or may not be a closed loop) may be generally free of conductive material. Additionally, at least some of the dielectric mounting substrate (e.g., the dielectric layer of a printed circuit board) on which the conductive segments 334 are mounted may also be omitted in the interior of the loop. In some embodiments, at least half of the area within the interior of the loop defined by the first and second conductive segments 334-1, 334-2 of each dipole arm 330 may comprise open areas 340. In embodiments where the dipole arms 330 are formed using printed circuit boards 332, these open areas 340 may be formed, for example, by removing the dielectric substrate of the printed circuit board 332. As shown best in FIG. 10, some of the dielectric of the printed circuit board 332 may be left in the interior of the loops to reduce the tendency of the printed circuit board 332 to bend and/or to provide locations for attaching the dipole support structure 318 to each dipole arm 330. In other embodiments, at least two-thirds of the area within the interior of the loop defined by the first and second conductive segments 334-1, 334-2 of each dipole arm 330 may comprise open areas 340.

As can also be seen in FIGS. 7-10, in some embodiments the first and second conductive segments 334-1, 334-2 may include meandered trace sections 338 that are in opposed positions about the axis of the dipole 320. In such embodiments, these opposed meandered trace sections 338 may extend toward the interior of the generally oval-shaped structure defined by the first and second conductive segments 334-1, 334-2, and hence may also extend toward each other. In some embodiments, all of the meandered trace sections 338 on each dipole arm 330 may extend towards an interior section of the dipole arm 330 that is between the first and second conductive segments 334-1, 334-2 of the dipole arm 330.

In some embodiments, capacitors may be formed between adjacent dipole arms 330 of different dipoles 320. For example, a first capacitor may be formed between dipole arms 330-1 and 330-3 and a second capacitor may be formed between dipole arms 330-2 and 330-4. These capacitors may be used to tune (improve) the return loss performance and/or antenna pattern for the low-band dipoles 320-1, 320-2. In some embodiments, the capacitors may be formed on the feed stalks 310.

By forming each dipole arm 330 as first and second spaced-apart conductive segments 334-1, 334-2, the currents that flow on the dipole arm 330 may be forced along two relatively narrow paths that are spaced apart from each other. This approach may provide better control over the radiation pattern. Additionally, by using the loop structure, the overall length of the dipole arm 330 may advantageously be reduced, allowing greater separation between each dipole arm 330 and the high-band radiating elements 400 and between each dipole arm 330 and the low-band radiating elements 300 in the other low-band array 220. Thus, the low-band radiating elements 300 according to embodiments of the present invention may be more compact and may provide better control over the radiation patterns, while also having very limited impact on the performance of closely spaced high-band radiating elements 400.

As noted above, the first dipole 320-1 is configured to transmit and receive RF signals at a +45 degree slant polarization, and the second dipole 320-2 is configured to transmit and receive RF signals at a −45 degree slant polarization. Accordingly, when the base station antenna 100 is mounted for normal operation, the first axis 322-1 of the first dipole 320-1 may be angled at about +45 degrees with respect to a longitudinal (vertical) axis L of the antenna 100, and the second axis 322-2 of the second dipole 320-2 may be angled at about −45 degrees with respect to the longitudinal axis L of the antenna 100.

As can best be seen in FIG. 10, central portions 344 of each of the first and second dipole arms 330 extend in parallel to the first axis 322-1, and central portions 344 of each of the third and fourth dipole arms 330 extend in parallel to the second axis 322-2. Moreover, the dipole arms 330 as a whole extend generally along one or the other of the first and second axes 322-1, 322-2. Consequently, each dipole 320 will directly radiate at either the +45° or the −45° polarization.

It will be appreciated that in other embodiments the dipole arms 330 may have shapes other than the generally oval shape shown in FIGS. 7-10. For example, in another embodiment, each dipole arm 330 may have a generally elongated rectangular shape (where an elongated rectangle refers to a rectangle that is not a square or nearly a square). In another embodiment, the oval and rectangular shapes may be combined so that the inner portion of the dipole arm 330 has a generally oval shape and the outer portion of the dipole arm 330 has a generally elongated rectangular shape. Such a shape may be considered to fall within the definition of the term "generally oval shape" and "generally elongated rectangular shape." Other embodiments are possible. In each case, the dipole arm 330 may have at least two spaced-apart conductive segments 334-1, 334-2 so that current splitting occurs with the currents flowing down at least two independent current paths on each dipole arm 330. Moreover, in each case the dipoles 320 may be center fed so that only two RF feed lines are required, namely one feed line for each dipole 320.

In some embodiments, the first and second dipoles 320-1, 320-2 may be formed using so-called "unbalanced" dipole arms 330. Herein the dipole arms 330 of a dipole 320 are unbalanced if the two dipole arms 330 have different conductive shapes or sizes. The use of unbalanced dipole arms 330 may help improve return loss performance and/or may improve the cross-polarization isolation performance of the low-band radiating elements 300, as will be discussed in more detail below.

Perhaps the most common dual band antenna is the RVV antenna, which typically includes a linear array of low-band radiating elements that has a linear array of high-band radiating elements on each side thereof, for a total of three linear arrays. In these RVV antennas, the low-band radiating elements typically run down the center of the antenna. As such, the portion of the reflector underlying the left two dipole arms of one of the low-band radiating elements may generally appear identical to the portion of the reflector underlying the right two dipole arms of the low-band radiating element. However, as shown in FIGS. 2-3, in the base station antenna 100, the linear arrays 230 of low-band radiating elements 300 are on the outer edges of the antenna 100. Moreover, as an RRVV antenna is necessarily large (due to the number of linear arrays and the inclusion of two low-band linear arrays, which have large radiating elements), efforts are typically made to reduce the width of the antenna as much as possible, which means that the low-band radiating elements 300 are typically positioned close to the side edges of the reflector 214. When the low-band radiating elements 300 are positioned close to the side edges of the reflector 214, the inner dipole arms 330 on each radiating element 300 may "see" more of the ground plane 214 than the outer dipole arms 330. This may cause an imbalance in current flow, which may negatively affect the patterns of the low-band antenna beams.

In order to correct this imbalance, the dipole arms 330 may be made to be unbalanced. This may be accomplished, for example, by modifying the length and/or width (and hence the surface area) of one or more of the widened sections 336 of conductive segments 334-1, 334-2. In the particular embodiment of FIGS. 7-10, it can be seen that the more distal widened sections 336 on conductive segments 334-1, 334-2 of dipole arms 330-1 and 330-3 have increased widths as compared to the corresponding widened sections of dipole arms 330-2 and 330-4. Modifying the lengths and/or widths of these sections 336 effectively changes the lengths of dipole arms 330-1 and 330-3 as compared to dipole arms 330-2 and 330-4. Notably, the dipole arms 330-1 and 330-3 with the increased amount of metallic surface area are the outer dipole arms 330 on each low-band radiating element 300 (i.e., the dipole arms 330 closest to the respective side edges of the base station antenna 100).

The low-band radiating elements 300 may also, in some cases, create a resonance at a frequency within the operating band of the high-band radiating elements 400. Such a resonance may degrade the antenna patterns of the high-band linear arrays 230. If this occurs, it has been discovered that the length of one or more of the narrow meandered traces 338 may be modified to move this resonance either lower or higher until it is out of the high-band. In some embodiments, the length of the distal narrow meandered traces 338 that connect the conductive segments 334-1 and 334-2 on dipole arms 330-2 and 330-4 may be changed, because changing the length of these narrow meandered traces 338 may tend to have the greatest impact on the high-band radiation patterns, and because the current magnitude through these distal narrow meandered traces 338 are relatively small and hence the change in length tends to have the lowest impact on the radiation pattern of the low-band radiating elements 300. The narrowed meandered traces 338 operate as inductive sections that have increased inductance.

Thus, pursuant to some embodiments of the present invention, methods of shifting a frequency of a resonance in a low-band radiating element are provided in which a length of an inductive trace section included in the low-band radiating element is adjusted to shift the resonance out of an operating frequency band of a closely located high-band radiating element. In some embodiments, the inductive trace sections that have their length adjusted are the inductive trace sections that are farthest from the location where the four dipole arms meet (which may be the location where the first and second axes 322-1, 322-2 cross).

FIG. 12 is a perspective view of one of the high-band feed board assemblies 260 that are included in the antenna 100. As shown in FIG. 12, the high-band feed board assembly 260 includes a printed circuit board 262 that has three high band radiating elements 400-1, 400-2, 400-3 extending upwardly therefrom. The printed circuit board 262 includes RF transmission line feeds 264 that provide RF signals to, and receive RF signals from, the respective high-band radiating elements 400-1 through 400-3. Each high-band radiating element 400 includes a pair of feed stalks 410 and first and second dipoles 420-1, 420-2.

The feed stalks 410 may each comprise a printed circuit board that has RF transmission line feeds formed thereon. The feed stalks 410 may be assembled together to form a vertically-extending column that has generally x-shaped horizontal cross-sections. Each dipole radiating element 420 comprises a printed circuit board having four plated sections (only three of which are visible in the view of FIG. 12) formed thereon that form the four dipole arms 430. The four dipole arms 430 are arranged in a general cruciform shape. Two of the opposed dipole arms 430 together form the first radiating element 420-1 that is designed to transmit signals having a +45 degree polarization, and the other two opposed dipole arms 430 together form the second radiating element 420-2 that is designed to transmit signals having a −45 degree polarization. The first and second radiating elements 420-1, 420-2 may be mounted approximately 0.16 to 0.25 of an operating wavelength above the reflector 214 by the feed stalks 410. Each high-band radiating element 400 may be adapted to have an azimuth half power beamwidth of approximately 65 degrees.

The radiating elements 400 illustrated in FIG. 12 also include directors 440 that are mounted on director supports 450 above the dipoles 420. The directors 440 may comprise metal plates that may be used to improve the pattern of the high-band antenna beams. The directors 440 may be omitted in some embodiments, as shown in various of the other figures.

Referring again to FIGS. 2-6, the base station antenna 100 may include a plurality of isolation structures and/or tuned parasitic elements that may be used to reduce coupling between the linear arrays 220, 230 and/or to shape one or more of the antenna beams.

FIG. 11 illustrates the dipoles 320-1, 320-2 of a low band radiating element 300' according to further embodiments of the present invention. The low band radiating element 300' is similar to the low band radiating element 300 described above, but in the low band radiating element 300' the distal ends of the conductive segments 334-1, 334-2 on all four dipole arms 330 are connected together by a meandered trace section 338, whereas in low band radiating element 300 only two of the dipole arms 330 had conductive segments 334-1, 334-2 that are connected together by respective meandered trace section 338 while the conductive segments 334-1, 334-2 on the other two dipole arms 330 are connected together by merging the distal widened sections 336 on each conductive segments 334-1, 334-2 together. It should be noted that the partial views of base station antenna 100 in FIGS. 5 and 6 include the radiating element 300' as opposed to the radiating element 300.

As discussed above, efforts are often made to decrease the width of an RRVV antenna. Typically, wireless operators want base station antennas to have a width of about 350 mm or less, although sometimes slightly wider antennas (e.g., 400 mm) are considered acceptable. If the antenna widths increase further, problems may arise in terms of wind loading on the antenna, which can require enhanced tower structures and/or antenna mounts, and issues of local zoning ordinances and unsatisfactory visual presentation may arise. In order to reduce widths as much as possible, it may be necessary to move the two linear arrays 220 of low-band radiating elements 300 closer together. Unfortunately, when this is done, it may result in the generation of common mode resonances in the radiating elements 300 of the second low-band array 220-2 when the first low-band array 220-1 is driven, and vice versa, due to the close proximity of the two linear arrays 220. In some case, these common mode resonances may, for example, distort the low-band antenna patterns in a narrow frequency range around, for example, 800 MHz. These common mode resonances may arise because in the narrow frequency range the current flow on the dipole arms 330 may flow in one or more undesired directions. The low-band radiating elements 300 according to embodiments of the present invention may suppress these common mode resonances via one or more of several different techniques.

In a first technique, a common mode filter may be built into the feed stalks 310 of the dipoles 320-1, 320-2 of each low-band radiating element 300. It has been shown via simulation that the inclusion of a common mode filter on the feed stalks 310 may be sufficient to filter out any common mode resonance that is generated in the feed stalks 310. The common mode filter may be implemented, for example, as a pair of inductive meandered lines coupled together along the RF transmission line 314.

Figure 13A:
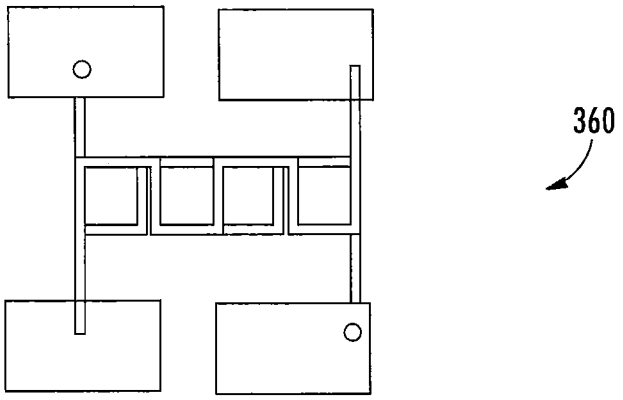
FIGS. 13A-13C are schematic diagrams illustrating an example implementation of a common mode filter that may be included on the feed stalks of the radiating elements of the base station antenna of FIGS. 1-6.
Figure 13B:
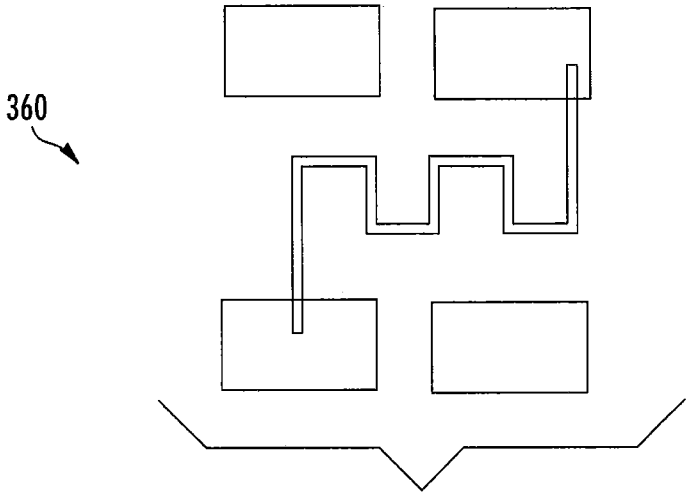
Figure 13C:
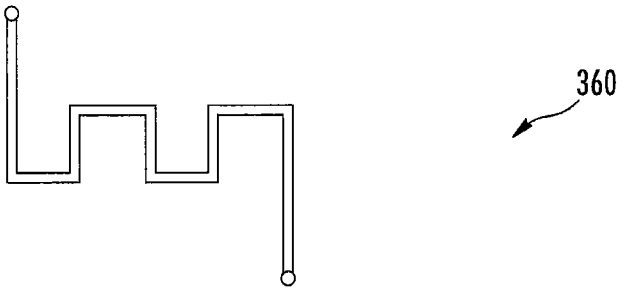

FIGS. 13A-13C are schematic diagrams illustrating one example implementation of such a common mode filter 360 on a feed stalk 310. In particular, FIG. 13A shows an embodiment of a feed stalk printed circuit board 310 with an integrated common mode filter. FIG. 13B shows the top layer metal layout of the feed stalk printed circuit board 310 and FIG. 13C shows the bottom layer metal layout of the of the feed stalk printed circuit board 310. The substrate material of the of the feed stalk printed circuit board 310 is omitted in FIGS. 13A-13C to better illustrate the structure the common mode filter 360. As shown in FIGS. 13A and 13B, the bottom left part of the RF transmission line is connected to the top right part of the RF transmission line via a narrowed meandered line. As shown in FIGS. 13A and 13C, the bottom right part of the RF transmission line is connected to the top left part of the RF transmission line via another narrowed meandered line and plated through holes. The two narrowed meandered lines which form the common mode filter are electromagnetically coupled together in the center. Due to mutual inductance interaction between the meandered lines, undesired in-phase currents on two sides of the RF transmission lines are suppressed whereas the out-of-phase currents on two sides of the RF transmission lines are allowed to pass through the filter. The common mode filter 360 may effectively block any common mode resonance that arises in the feed stalks 310.

Figure 14:
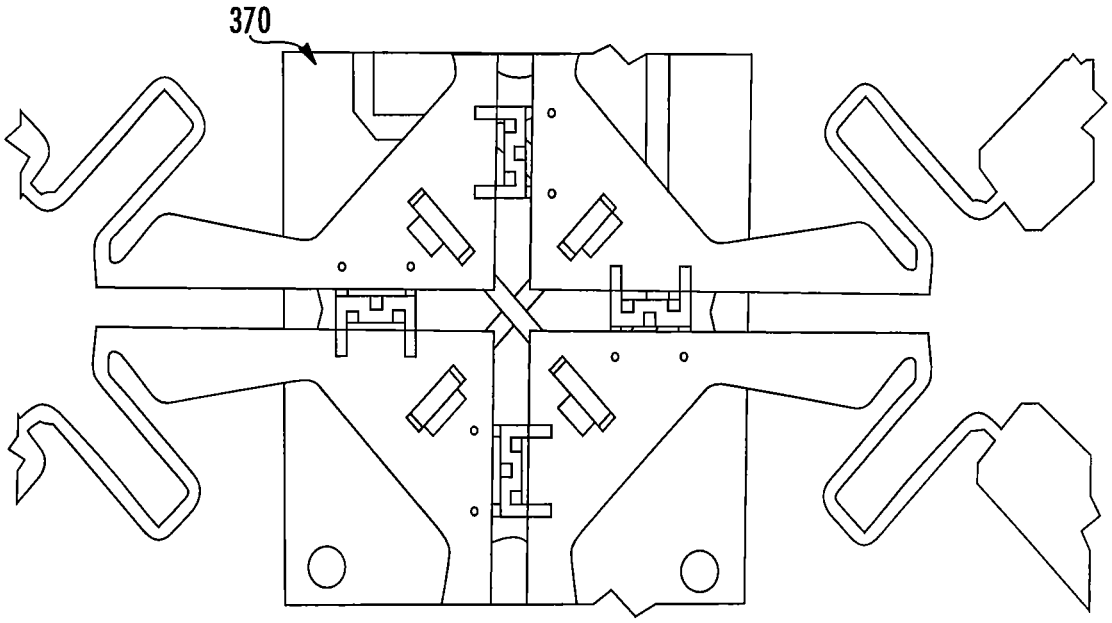
FIG. 14 is a schematic diagram illustrating an example implementation of a common mode filter that may be integrated into the dipole arms of the low-band radiating elements of the base station antenna of FIGS. 1-6.

It will be appreciated, however, that common mode resonances may be more likely to arise in the dipole arms 330 than the feed stalks 310 as the dipole arms 330 of the two low-band arrays 220 are closer to each other than are the feed stalks 310 of the two low-band low arrays 220. FIG. 14 illustrates a common mode filter 370 according to further embodiments of the present invention. The common mode filters 360 and/or 370 may be implemented on any of the low-band radiating elements 300 according to embodiments of the present invention (and may also be implemented on the high-band radiating elements 400 in some embodiments).

As shown in FIG. 14, the common mode filter 370 may be implemented near the center of the radiating element 300. The same concept explained above with reference to FIGS. 13A-13C for a common mode filter implemented on a feed stalk printed circuit board 310 may be applied on the dipole arms 330 to stop in phase currents from flowing on either side of the capacitors 342.

In a second approach, the common mode resonance may be reduced or potentially eliminated by decreasing the gaps 350 between adjacent dipole arms 330 in the center of the radiating element 300. In particular, the frequency at which the common mode resonances arises may be a function of the gap size, with the common mode resonance occurring at higher frequencies as the width of the gap 350 is increased. At certain gap widths, the common mode resonance may fall within the operating band of the low-band radiating elements 300. Unfortunately, however, reducing the widths of these gaps 350 may make it more difficult to impedance match the dipole arms 330 with the RF transmission lines 314 on the feed stalks 310. If the impedance matching of the dipole arms 330 and feed stalks 310 is degraded, the return loss of the low-band radiating element 300 is increased.

Figure 15:
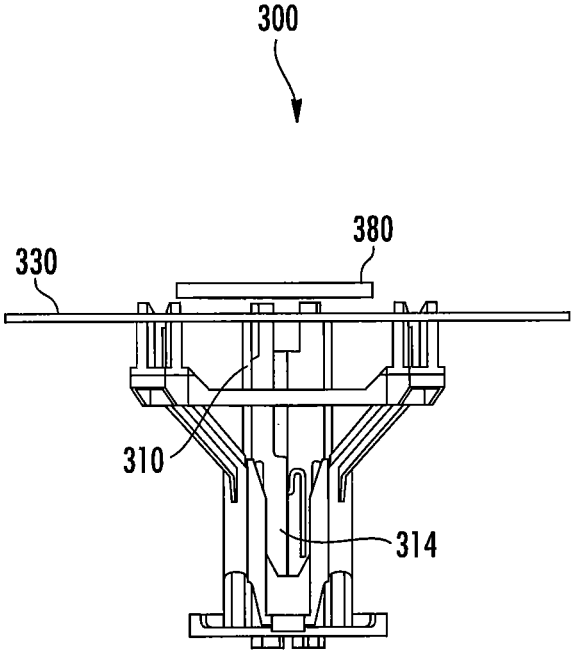
FIG. 15 is a perspective view of a low-band radiating element assembly according to embodiments of the present invention that includes respective conductive plates mounted above the center section of the dipole arms of each low-band radiating element.

As shown in FIG. 15, pursuant to embodiments of the present invention, a conductive plate 380 may be placed over the center of the radiating element 300 that capacitively couples with the dipole arms 330. The conductive plate 380 may be similar to a director such as, for example, the director 440 shown at FIGS. 5A-5D of U.S. Patent Application Ser. No. 62/312,701 (the '701 application"), filed Mar. 24, 2016, except that the conductive plate 380 may be smaller and/or much closer to the dipoles 320 than is the director disclosed in the '701 application. The conductive plate 380 may move the frequency of the common mode resonance lower and can be used to move the resonant frequency out of the low-band. The size of the gap 350 can be adjusted to some extent to further tune where the common mode resonance falls. The conductive plate 380 may act as a parasitic capacitance that may be used to move the frequency at which the common mode resonance occurs to a desirable location.

Pursuant to yet another technique, the common mode resonance may be tuned to an unused part of the spectrum that is within the low-band. As discussed above, by adjusting the size (width) of the gap 350 between adjacent dipole arms 330 it may be possible to adjust the frequency where the common mode resonance occurs. Unfortunately, when the common mode resonance occurs near the middle of the low-band, the adjustment to the width of the gap 350 necessary to move the common mode resonance out-of-band may be sufficiently large that it makes it difficult to impedance match the dipole arms 330 to the feed stalks 310, which can result in degraded return loss performance. However, in at least some jurisdictions, a small part of the spectrum within the low-band may be unused. In particular, in North America, there is a 24 MHz portion of the low-band spectrum that is centered at about 811 MHz that is not currently in use by some operators. Pursuant to embodiments of the present invention, the width of the gaps 350 may be adjusted to tune a common mode resonance that occurs in the low-band so that it falls within this unused portion of the spectrum. While the common mode resonance may degrade the antenna pattern in this portion of the spectrum, the low-band radiating elements do not transmit or receive signals in this frequency band, and hence the degradation is not of particular concern. This approach may be successful because the common mode resonance may be very narrow and hence may be tuned to fall mostly or completely within an unused portion of the low-band spectrum.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A radiating element, comprising:

a first dipole arm that includes first and second conductive segments, where a central portion of the first conductive segment is spaced apart from a central portion of the second conductive segment, wherein the first conductive segment includes a first meandered trace that extends into a region between the first and second conductive segments, and the second conductive segment includes a second meandered trace that also extends into the region between the first and second conductive segments.

2. The radiating element of claim 1, wherein the first dipole arm includes at least a third meandered trace, and all of the meandered traces of the first dipole arm extend into the region between the first and second conductive segments.

3. The radiating element of claim 1, wherein the radiating element further comprises second through fourth dipole arms, where the first and second dipole arms form a first dipole that extends along a first axis, and the third and fourth dipole arms form a second dipole that extends along a second axis, the second axis being generally perpendicular to the first axis.

4. The radiating element of claim 3, wherein the first and second meandered traces are in opposed positions about the first axis.

5. The radiating element of claim 3, wherein the first and second meandered traces extend toward each other.

6. The radiating element of claim 1, wherein the radiating element is a lower-band radiating element that is part of an array of lower-band radiating elements of a base station antenna, the base station antenna further comprising an array of higher-band radiating elements, and wherein the first and second meandered traces are configured to interrupt currents in the frequency range of the higher-band radiating elements.

7. The radiating element of claim 1, wherein the first dipole arm has a generally oval shape.

8. A radiating element, comprising:

a first dipole that extends along a first axis, the first dipole including a first dipole arm and a second dipole arm; and a second dipole that extends along a second axis, the second dipole including a third dipole arm and a fourth dipole arm, the second axis being generally perpendicular to the first axis, wherein each of the first through fourth dipole arms comprises a respective closed loop conductive path that includes at least first and second meandered traces that extend into an interior of the closed loop.

9. The radiating element of claim 8, wherein each of the first through fourth dipole arms further includes at least a third meandered trace.

10. The radiating element of claim 9, wherein the first dipole arm includes first and second conductive segments that form opposed sides of the closed loop, wherein the first meandered trace of the first dipole arm is part of the first conductive segment and the second meandered trace of the first dipole arm is part of the second conductive segment.

11. The radiating element of claim 10, wherein the first dipole arm has a generally oval shape.

12. The radiating element of claim 11, wherein the first and second conductive segments perform current splitting to provide first and second independent current paths on the first dipole arm.

13. The radiating element of claim 9, wherein first and second meandered traces of the first dipole arm extend toward each other and generally perpendicular to the first axis, and the third meandered trace of the first dipole arm extends generally parallel to the first axis.

14. The radiating element of claim 8, wherein the first and second meandered traces of the first dipole arm are in opposed positions about the first axis.

15. The radiating element of claim 14, wherein the radiating element is a lower-band radiating element that is part of an array of lower-band radiating elements of a base station antenna that further comprises an array of higher-band radiating elements, and wherein the first and second meandered traces of the first dipole arm are configured to interrupt currents in the frequency range of the higher-band radiating elements.

16. The radiating element of claim 8, wherein the first and second meandered traces of the first dipole arm extend toward each other.

17. A radiating element, comprising:

a first dipole arm comprising a first conductive segment that includes a first meandered trace, a second conductive segment that includes a second meandered trace, and a third meandered trace, wherein the first and second meandered traces extend toward each other along a first direction, and the third meandered trace extends in a second direction that is generally perpendicular to the first direction.

18. The radiating element of claim 17, wherein the radiating element further comprises second through fourth dipole arms, where the first and second dipole arms form a first dipole that extends along a first axis, and the third and fourth dipole arms form a second dipole that extends along a second axis, the second axis being generally perpendicular to the first axis.

19. The radiating element of claim 18, wherein the first and second meandered traces are in opposed positions about the first axis.

20. The radiating element of claim 19, wherein the radiating element is a lower-band radiating element that is part of an array of lower-band radiating elements of a base station antenna that further comprises an array of higher-band radiating elements, and wherein the first and second meandered traces are configured to interrupt currents in the frequency range of the higher-band radiating elements.

* * * * *